US005419601A

United States Patent [19]

Mikkola

[11] Patent Number: 5,419,601

[45] Date of Patent: May 30, 1995

[54] LIFTING DEVICE

[75] Inventor: Pentti Mikkola, deceased, late of Pori, Finland, by Matti Hellberg, legal representative

[73] Assignees: Kullervo Mikkola; Martti Honkasalo, both of Nakkila, Finland

[21] Appl. No.: 129,199

[22] PCT Filed: Apr. 9, 1992

[86] PCT No.: PCT/FI92/00110

§ 371 Date: Mar. 17, 1994

§ 102(e) Date: Mar. 17, 1994

[87] PCT Pub. No.: WO92/18415

PCT Pub. Date: Oct. 29, 1993

[30] Foreign Application Priority Data

Apr. 9, 1991 [FI] Finland ..... 911696

[51] Int. Cl.[6] ..... B66C 1/22

[52] U.S. Cl. ..... 294/67.1; 294/67.22; 294/68.21; 294/63.1

[58] Field of Search ..... 294/67.1, 67.2, 67.21, 294/67.22, 68.1, 68.2, 68.21, 63.1

[56] References Cited

U.S. PATENT DOCUMENTS

| | | | |
|---|---|---|---|
| 1,555,022 | 9/1925 | Proctor | 294/63.1 |
| 3,572,802 | 3/1971 | Zupancic | 294/67.22 |
| 3,863,971 | 2/1975 | Meads et al. | 294/63.1 X |

FOREIGN PATENT DOCUMENTS

| | | | |
|---|---|---|---|
| 1379427 | 10/1964 | France | 294/67.22 |
| 3117012 | 11/1982 | Germany | 294/67.1 |
| 398006 | 2/1966 | Switzerland | 294/67.22 |

*Primary Examiner*—Dean J. Kramer
*Attorney, Agent, or Firm*—Ladas & Parry

[57] ABSTRACT

A lifting device for lifting a load positioned on a platform in which a hollow protective framework has a coupling at its upper end and a slidable lifting element is mounted at the lower end of the framework. The framework is formed by a rigid assembly of bars and supporting walls and the framework includes tubular supports which slidably receive support members of the lifting element. The lifting element is slidably moved to a retracted position and the framework is lowered onto the load whereafter the lifting element is slidably displaced to an inserted position within the framework where the lifting element now supports the platform from below so that when the framework is lifted, the lifting element will lift the load therewith.

8 Claims, 2 Drawing Sheets

LIFTING DEVICE

FIELD OF THE INVENTION

The invention relates to a lifting device for lifting loads positioned on a platform, the lifting device comprising at least one coupling means for lifting it; at least one lifting means arranged to be pushed horizontally under the platform and to be supported by the coupling means at one end; and a protective framework positioned substantially above the lifting means and comprising protective walls surrounding the load on all sides at least during the lifting stage.

BACKGROUND AND PRIOR ART

A separate lifting device is required when lifting loads of bricks stacked on pallets or other goods positioned in an easily collapsible stack on a platform. For reasons of safety at work in particular, this kind of lifting device has to be constructed so that it comprises not only a load carrying part, i.e. supporting means to be inserted under the pallet or platform, but also a wall, a grating, for instance, which is closed during lifting so as to surround the load on all sides in order to prevent the falling of the objects or products contained in the load during lifting. It is well-known to insert a lifting plate or alternatively a lifting fork under the pallet or platform of the stack of bricks, from which plate or fork a support arm projects above the stack of bricks so that a lifting hook acting as a coupling means is lifted substantially at its centre of gravity when loaded. This known arrangement further comprises a cage to be positioned around the stack of bricks, the front wall of the cage, that is, the wall on the side of the point portion of the lifting means, is openable about a vertical axis, so that when the door is open, the lifting device can be pushed so that the lifting means is positioned under the platform of the stack of bricks at the same time as the stack of bricks is positioned within the cage. After the door has been closed, the stack of bricks can be lifted by the lifting device. A drawback of this known arrangement is that the positioning of the stack of bricks always requires that the cage door should be opened, which required extra space and thus makes the work more difficult. Moreover, the entire lifting device has to be displaced in the transverse direction so as to insert the lifting means under the stack and to remove the lifting device so that it can be displaced to the following lifting stage. Still another drawback of the known lifting device is that the person handling it first has to go to one side of the device to open the door and then to the other side to push or pull the lifting device in position or to withdraw it.

DE Offenlegungsschrift 3 013 488 discloses a solution in which the lifting means itself and the support frame are similar to those of the device described above whereas the cage portion can be lifted and lowered in the direction of the height of the lifting device so as to make the device support the stack of bricks and to remove it from the device. These arrangements are rather heavy and as the person handling the device has to displace the entire device to the lifting point under the stack or away therefrom, the work is very strenuous. Furthermore, the cage structure is very complicated and cumbersome and expensive to manufacture.

U.S. Pat. No. 2,757,035 discloses an arrangement in which the lifting means are fixed to the frame pivotally with respect to it so that they can be inserted under the load and withdrawn, respectively, a spring force being applied to maintain them in both positions. This arrangement does not comprise any protective cage or protective framework and it cannot be used as such without a serious risk of injury. In addition, the solution is very complicated to manufacture.

SUMMARY OF THE INVENTION

The object of the present invention is to provide a lifting device which avoids the abovementioned drawbacks and by means of which loads, such as stacks of bricks, can be lifted very close to each other or from very close to each other without any unnecessary work. The solution according to the invention is characterized in that the protective framework is integral, being formed by the protective walls attached fixedly together and arranged to be lowered from above around the load, that two opposite walls of the protective framework are provided with horizontal support guides, that the protective framework comprises at least two supports arranged to be fitted slideably in the longitudinal direction into the support guides provided in the opposite walls of the protective framework, that each lifting means is connected at one end to at least two supports so that it is displaceable on the supports in the transverse direction of the protective framework so as to retract the lifting means from below the protective framework and to insert it under the protective framework.

The basic idea of the invention is that the protective framework is substantially fixed and closed on all sides so that it can be lifted and lowered upon the load to be lifted, such as a stack of bricks, and correspondingly lifted away therefrom, and that the lifting means can be pushed in the transverse direction of the framework, and they are provided with supports resting on guides mounted in the framework, the supports carrying the load supported by the framework. An advantage of the arrangement according to the invention is that the lifting and lowering of the protective framework requires only a very small space between two adjacent loads. Furthermore, the weight of the lifting means structure displaceable in the transverse direction is very low as compared with the weight of the whole lifting device, and so the strain caused by it is considerably smaller than the strain caused by the prior art lifting devices. Also, as a person handling the lifting means is required only on one side of the lifting device for displacing the lifting means, one does not need to go around the device and thus the resultant strains and risk situations are avoided. Still another advantage is that the worker can, if required, rest against the framework when displacing the lifting means, pulling or pushing it when the lifting means is hampered by impurities, a protuberance or the like on the underlying surface.

BRIEF DESCRIPTION OF THE DRAWINGS

The invention will be described in more detail in the attached drawings, in which FIG. 1 a schematic perspective view of the lifting device according to the invention with the lifting means retracted.

DETAILED DESCRIPTION

Figure 1:
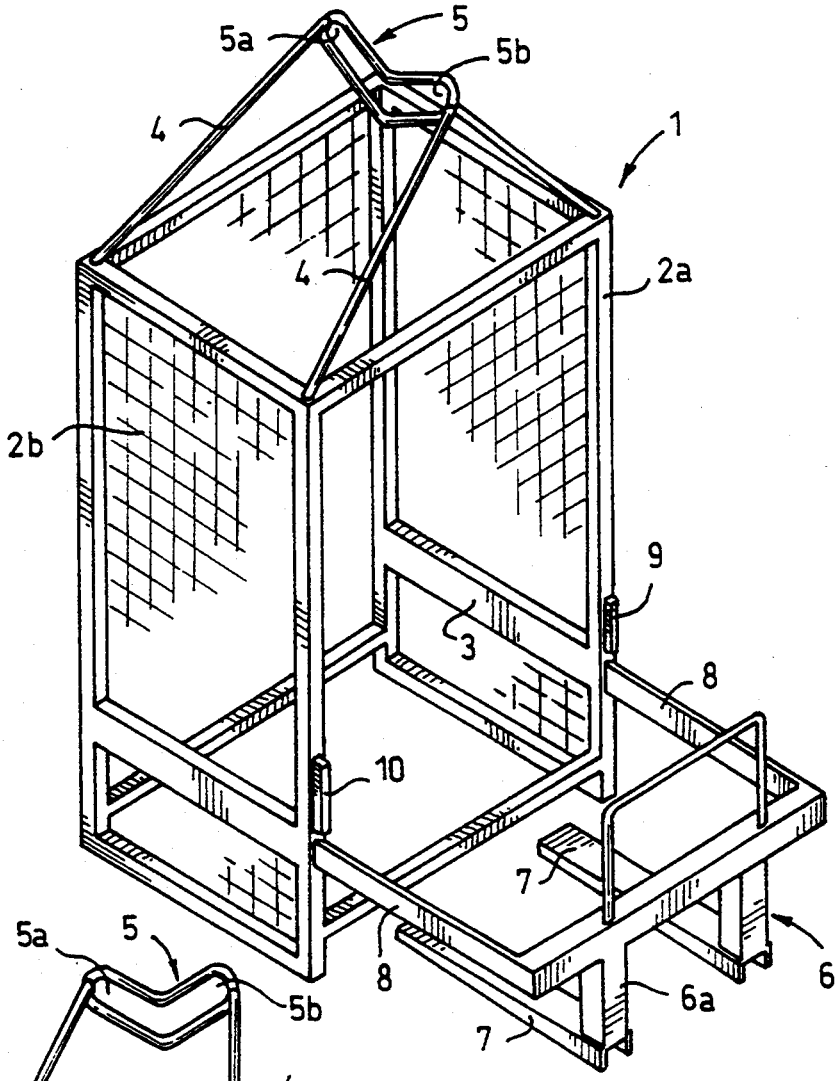

The drawing show a lifting device 1 comprising an integral protective framework 2. As shown in the drawings, the protective framework is made by welding together frame tubes 2a into a fixed frame rectangular in cross-section. Further, a protective wall 2b made of grating is provided on all sides of the lifting device either over the length of the side or over a portion of its length. Furthermore, support guides 3, that is, as shown in the drawings, support pipes 3, are fixed horizontally in the lower portion of the frame on its two parallel, opposite sides. A support arm 4 projects from each corner of the lifting device 1 in the upper portion of the protective framework 2, each arm being welded to the corners of the lifting device and correspondingly to a lifting lug 5 positioned centrally in the lifting device and acting as a coupling means. An opening is provided in the lower portion of the lifting device on its one side between the support pipes 3, the opening extending up to the lower edge of the lifting device so that a lifting means 6 can be pushed in position. The lifting lug 5 is made of steel so that it comprises two lifting points 5a and 5b, of which one is closer to the middle point of the lifting device for lifting it when loaded, and the other is on the side of the protective framework 2 close to the lifting means so that when the lifting device is lifted from it, it settles in an upright position when unloaded and with the lifting means retracted. The lifting means 6 comprises a frame 6a on which the load actually rests when the lifting means 6 is suspended from the protective framework 2. The frame 6a is provided at its lower end with two lifting forks 7 each attached to it at its one end, the forks being intended to be inserted under the platform of the load to be lifted. Further, support arms 8 extend from the upper portion of the frame 6a in parallel with the lifting forks 7, the support arms being dimensioned so that they can be inserted into the support pipes 3 attached to the lifting framework so that the lifting means is slideable on the support pipes 3.

Figure 2:
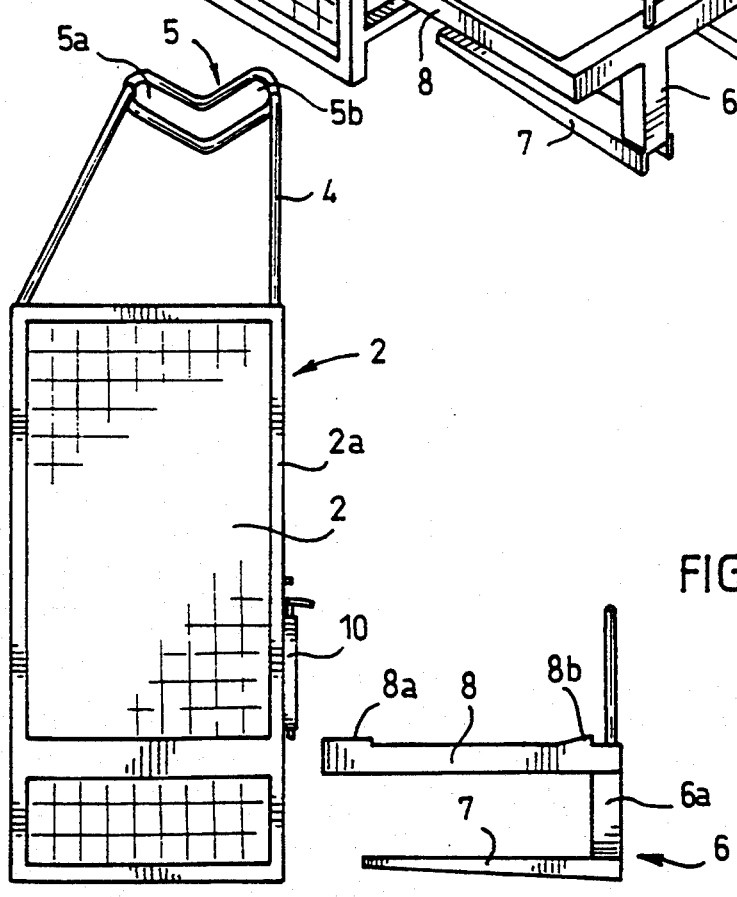
FIG. 2 is a side view of the lifting device according to the invention.

FIG. 2 shows the lifting device of FIG. 1 from the side with the lifting means 6 retracted. In this situation, the lifting device can be displaced from one place to another e.g. for fetching a new load. It also appears from the figure how the position of the lifting means with respect to the protective framework 2 is secured. Each support 8 is provided at its forward end with enlarged portions 8a protruding upward from the supports 8, and limiters 9 are secured to the protective framework 2 on the side close to the supporters, the limiters preventing the supporters from falling fully out of the support pipes 3. One of the supporters 8 is further provided with an upwardly extending wedge-like projection 8b in the end close to the frame of the lifting means 6; correspondingly, the frame of the protective framework 2 is provided on the same side with a liftable locking means 10 by means of which the support 8 is locked in position when it is in the inserted position, and it can be moved outward only when the locking means 10 is lifted up.

Figure 3:
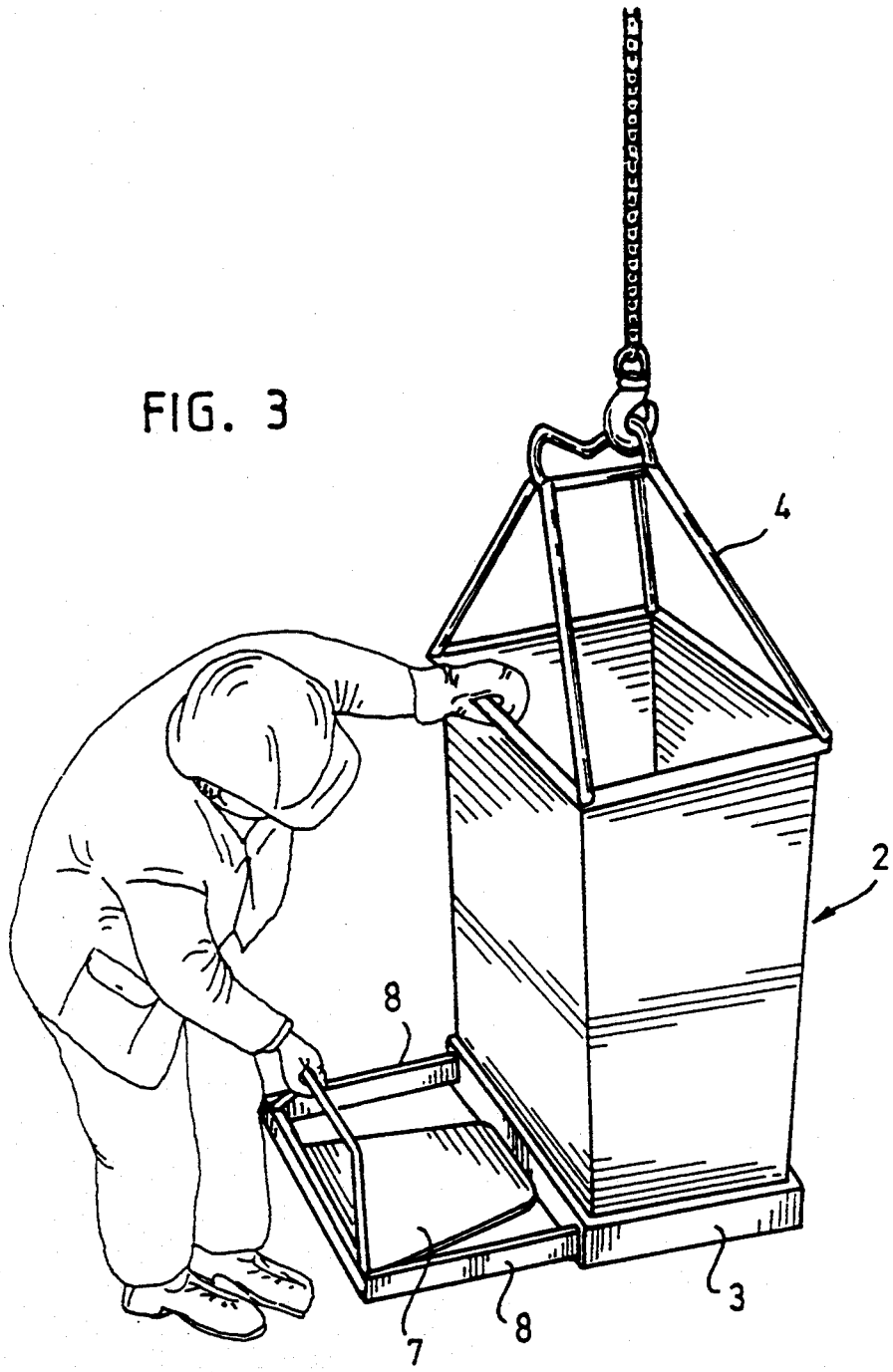
FIG. 3 illustrates schematically the working with the lifting device according to the invention.

FIG. 3 is a perspective view of a situation in which the lifting device 1 has been installed around a stack of bricks by lowering it downward while the lifting means is in the retracted position, and the worker pushes the lifting means 6 inward for lifting the load. When the lifting means is in the inserted position, the load surrounded by it can be lifted as desired without any risk of the load collapsing and falling down. As appears from FIG. 3, the worker can grip the edge of the protective framework 2 with one hand for support while pushing the lifting means 6 inward with the other hand.

The invention has been described in the above specification and in the drawings only by way of example, and it is in no way restricted to this example. In FIGS. 1 and 2, the supports of the lifting means 6 are shown to be positioned significantly above the lifting fork 7, which is practical when working in winter conditions in snow or in otherwise difficult terrain conditions, as the space between the supports 8 and the support pipes 3 will not be filled with impurities or snow, which would hamper the use of the invention. In favorable conditions, however, they may be positioned nearly in level with the lifting forks 7 or only slightly above them, as shown in FIG. 3. In place of the lifting forks 7, it is possible to use a lifting plate, as shown in FIG. 3, or other similar structure if it is possible in view of the products or loads to be lifted. The walls of the protective framework 2, that is, the wall plates, may consist of grating secured to the frame, of solid plate or of separate transverse or vertical irons or the like. The lifting lug may be different in shape, and it may comprise a continuous lifting loop or two separate loops. The lifting lug may also be pivotable or displaceable in a manner known per se. The frame and structure of the lifting means 6 can be realized in many different ways, and the supports 8 can also be secured to it in different ways. Essential is, however, that the lifting means can be retracted from its supporting position in a direction transverse to the vertical axis of the protective framework of the lifting device so that the lifting fork or other such lifting means can be inserted under the platform of the load to be lifted easily and lightly. The lifting loop can be attached to the lifting device either as appears from the drawings and the description above or by positioning it on support beams parallel to the opposite walls of the protective frame work and an interconnecting transverse beam. The lifting device can be lifting by tower cranes and other such lifters used widely on construction sites, and lifting chains or the like connected to various machines can be used as well. In one embodiment of the invention, the lifting means 6 is connectable by suitable concerning means directly to the bucket are of a bucket loader or the like, and so the protective framework could be displaceable by separate actuating means with respect to the lifting means 6 in its longitudinal direction, and the bucket loader would push the lifting means under the load after the protective framework has been positioned around the load, and vice versa.

What is claimed is:

1. A lifting device for lifting loads positioned on a platform, the lifting device comprising at least one coupling means for lifting the platform; at least one lifting means arranged to be pushed horizontally under the platform and to be supported by the coupling means; and a protective framework extending substantially above the lifting means and connected to said coupling means, said protective framework comprising protective walls surrounding the load on all sides at least during a lifting stage, said protective framework being integrally formed by the protective walls attached fixedly together and arranged to be lowered from above around the load and two opposite walls of the protective framework are provided with horizontal support guides, said lifting means comprising two supports fitted slidably in said support guides provided at the opposite walls of the protective framework, so that the lifting means is displaceable in the support guides in a transverse direction of the protective framework so as to retract the lifting means from the protective framework and to insert the lifting means into the protective framework to engage the platform from below.

2. A lifting device according to claim 1, wherein the protective framework comprises a load carrying frame portion and a protective plate secured to said frame portion to form each of said walls of the framework, the coupling means is connected to an upper end of the frame portion, and each support guide is secured to the frame portion.

3. A lifting device according to claim 2, wherein the support guides are mounted on the frame portion at a distance from a lower end of the frame portion.

4. A lifting device according to claim 1, wherein the support guides are straight and tubular in shape, and the supports are arranged to be inserted into the support guides.

5. A lifting device according to claim 1, wherein the supports have a greater length in their direction of movement than the lifting means so that when the lifting means is fully retracted from under the protective framework, a part of the length of the supports is still connected to the support guides.

6. A lifting device according to claim 1, wherein said protective framework has a lower end which is open to enable the protective framework to be lowered onto the load to be lifted, said lifting means being located proximate said lower end of the protective framework and being retracted from the framework when the framework is lowered onto the load.

7. A lifting device according to claim 6, wherein said lifting means includes forks engageable below the platform when the lifting means is inserted into the protective framework.

8. A lifting device according to claim 7, comprising handle means on said lifting means for displacing the lifting means between the retracted and inserted portions.

* * * * *